United States Patent [19]

Tamura et al.

[11] Patent Number: 4,823,758

[45] Date of Patent: Apr. 25, 1989

[54] MECHANICAL SUPERCHARGER

[75] Inventors: Toru Tamura, Ohbu; Masaki Chujo, Chiryu; Kazuharu Jinnouchi, Toyota, all of Japan

[73] Assignee: Aisin Seiki Kabushiki Kaisha, Kariya, Japan

[21] Appl. No.: 87,823

[22] Filed: Aug. 21, 1987

[30] Foreign Application Priority Data

Aug. 22, 1986 [JP] Japan ..... 61-127212

[51] Int. Cl.[4] ..... F02B 33/38; F04C 18/08

[52] U.S. Cl. ..... 123/564; 417/310; 418/206

[58] Field of Search ..... 123/564; 623/559.1, 623/559.3; 417/307, 310; 418/206

[56] References Cited

U.S. PATENT DOCUMENTS

| | | | |
|---|---|---|---|
| 3,128,710 | 4/1964 | Blomgren et al. | 417/310 |
| 3,322,134 | 5/1967 | Enemark | 417/310 X |
| 4,502,283 | 3/1985 | Wandel | 123/564 X |

FOREIGN PATENT DOCUMENTS

| | | | |
|---|---|---|---|
| 259208 | 6/1949 | Switzerland | 123/559.1 |

*Primary Examiner*—Michael Koczo

*Attorney, Agent, or Firm*—Oblon, Fisher, Spivak, McClelland & Maier

[57] ABSTRACT

A mechanical supercharger utilized in internal combustion engines includes a housing having an inlet port and an outlet port, and a bypass passage disposed in the housing for connecting the inlet port and the outlet port with each other. A relief valve is disposed in the bypass passage for releasing air pressure from the outlet port to the inlet port.

4 Claims, 3 Drawing Sheets

MECHANICAL SUPERCHARGER

BACKGROUND OF THE INVENTION

1. Field of the Invention:

This invention relates a mechanical supercharger utilized in internal combustion engines, and more particularly to a mechanical supercharger wherein a relief control valve is accommodated.

2. Discussion of Background Art:

It is well known that a relief control valve may be generally adopted to control supercharging pressure in a mechanical supercharger. In a conventional supercharger with a relief control valve, as shown in FIG. 1, a surge tank 51 is connected to an intake manifold 58 of an internal combustion engine 55. A relief control valve 52 is disposed in the surge tank 51 so as to keep a suction air pressure in the surge tank 51 under a predetermined value. The relief air from the relief control valve 52 is returned to an upstream portion of the supercharger 53 or to an air cleaner 57 via a control conduit 54 that is separate from the supercharger 53. Numeral 56 indicates a carburetor.

In the above-mentioned conventional relief control system, however since the control conduit 54 is positioned outside of the supercharger 53 and the construction of the relief control valve 52 is complicated, there is a drawback that the device has a large size. Furthermore, in the conventional mechanical supercharger, noises are generated by discharge pulsations of the supercharging pressure released from the relief control valve. In addition, when the control conduit is disposed on the outside of the supercharger, there is a noise problem in that noise radiates from the control conduit. When the mechanical supercharger 53 is located downstream from the carburetor 56 as shown in FIG. 1, there will be a further problem in that gasoline vapors can leak out from the joints of the control conduit 54.

SUMMARY OF THE INVENTION

Accordingly, an object of the present invention is to eliminate the above disadvantages of prior art mechanical superchargers.

More particularly, it is an object of the present invention to provide a mechanical supercharger wherein the generation of noises and leakage of gasoline vapors is substantially prevented. Additional objects and advantages of the present invention will be set forth in the description that follows.

To achieve the objects and in accordance with the purpose of the invention, as embodied and as broadly described herein, a mechanical supercharger for compressing the precombustion intake mixture for an internal combustion engine comprises a housing having an inlet port and an outlet port; compression means in the housing for compressing the precombustion intake mixture provided through the inlet port and discharging the compressed precombustion mixture through the outlet port; passage means disposed in the housing for connecting the inlet port with the outlet port; and relief valve means disposed in the passage means for selectively releasing outlet port pressure to the inlet port via the passage means, thereby controlling the opening and closing of the relief valve means in response to changes in the outlet port pressure.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 5:
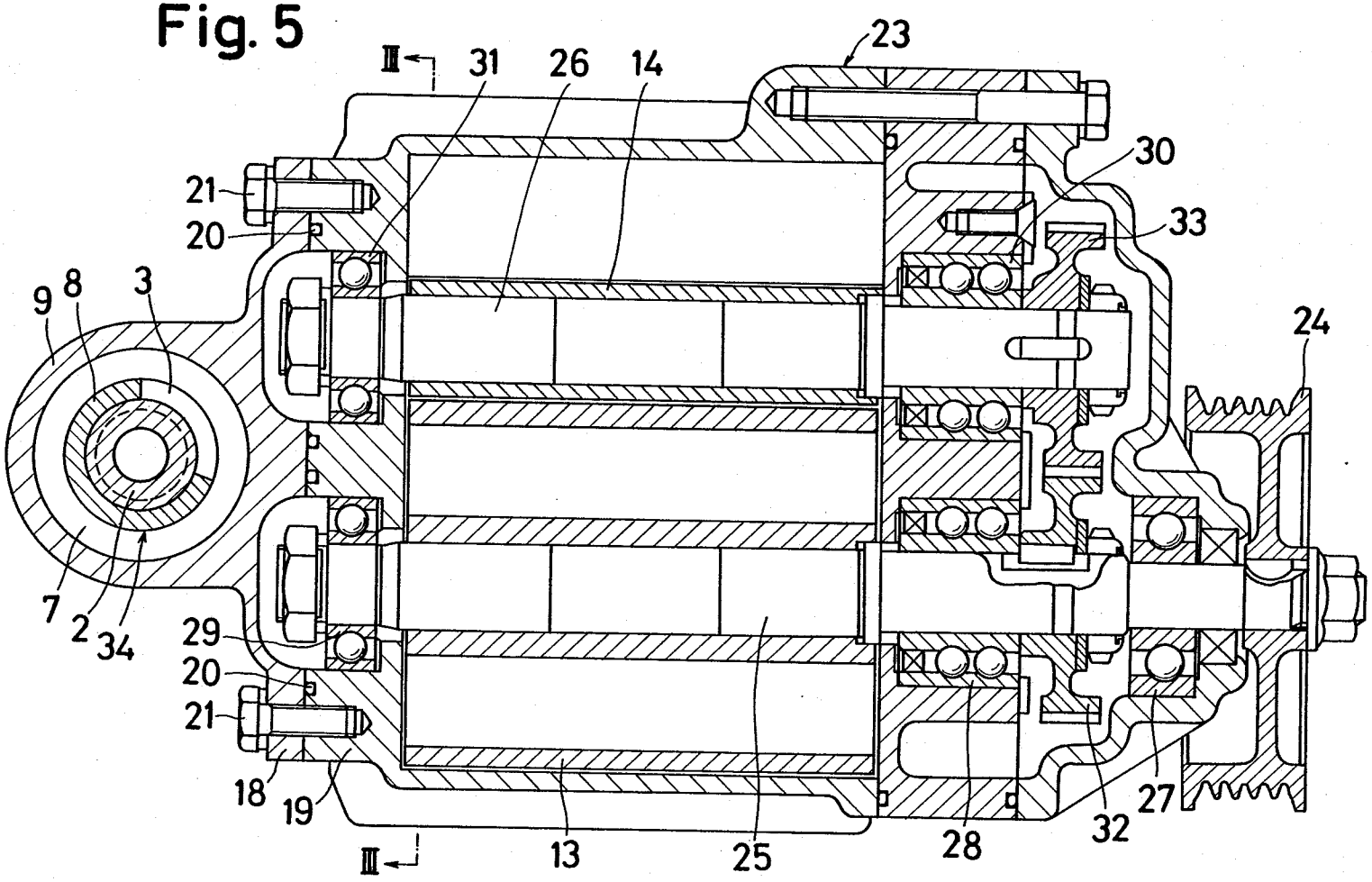
FIG. 5 is a sectional view of a mechanical supercharger constructed in accordance with one preferred embodiment of the present invention.

Referring to FIG. 5 of the drawings, there is shown a Roots type mechanical supercharger 23 which is driven by an engine through a pulley 24. A shaft 25 is rotatably supported by bearings 27, 28, 29. Fixed on the shaft 25 is a rotor 13 which rotates in a housing 19. A shaft 26 is rotatably supported by bearings 30, 31. Fixed on the shaft 26 is a rotor 14 which rotates in the direction opposite to the rotor 13 while maintaining a small gap from the rotor 13. Gears 32, 33 are fixed to the shaft 25, 26, respectively. The rotation of the shaft 25 is transmitted to the shaft 26 through the gear 33 engaging with the gear 32. An end housing 9 forms the end of the housing 19 opposite the pulley 24 and includes a flange 18 hermetically sealed to the housing 19 via bolts 21 and O-ring 20.

Figure 3:
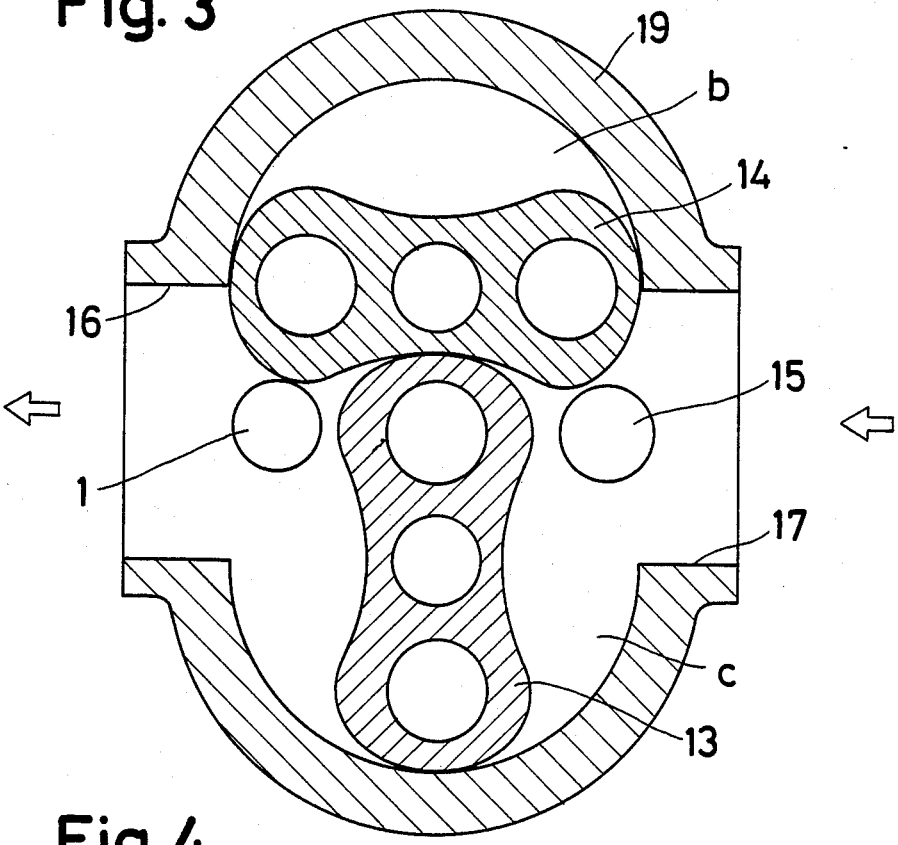
FIG. 3 is a sectional view taken along line III—III of FIG. 5.
Figure 4:
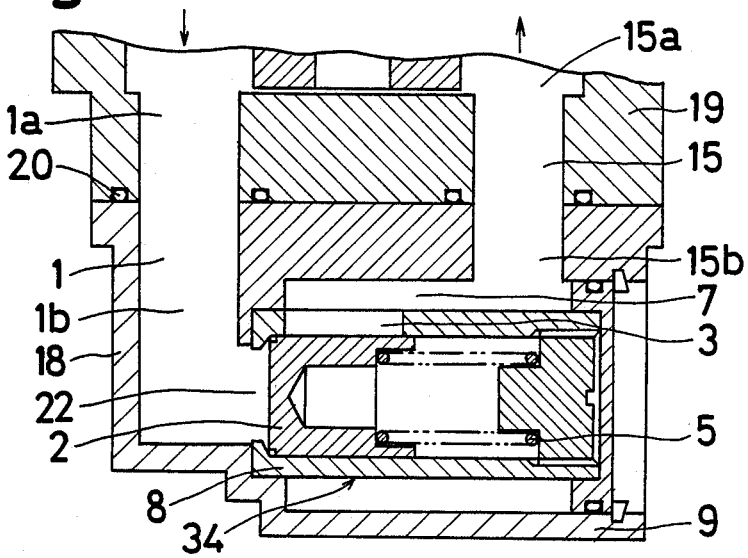
FIG. 4 is a sectional view taken along line IV—IV of FIG. 2.

Referring to FIG. 3 and FIG. 4, the housing 19 is provided with passages 1*a*, 15*a* in the side thereof opposite the pulley 24. The housing 9 is provided with passages 1*b*, 15*b* positioned in alignment with the passages 1*a*, 15*a*. A passage 1 consisting of the passages 1*a*, 1*b* is connected with an outlet port 16 of the supercharger 23. A passage 15 consisting of the passages 15*a*, 15*b* is connected with an inlet port 17 of the supercharger 23. The passage 1 is connected with the passage 15 via chamber 7 of housing 9 to form a bypass passage forming passage means.

Figure 2:
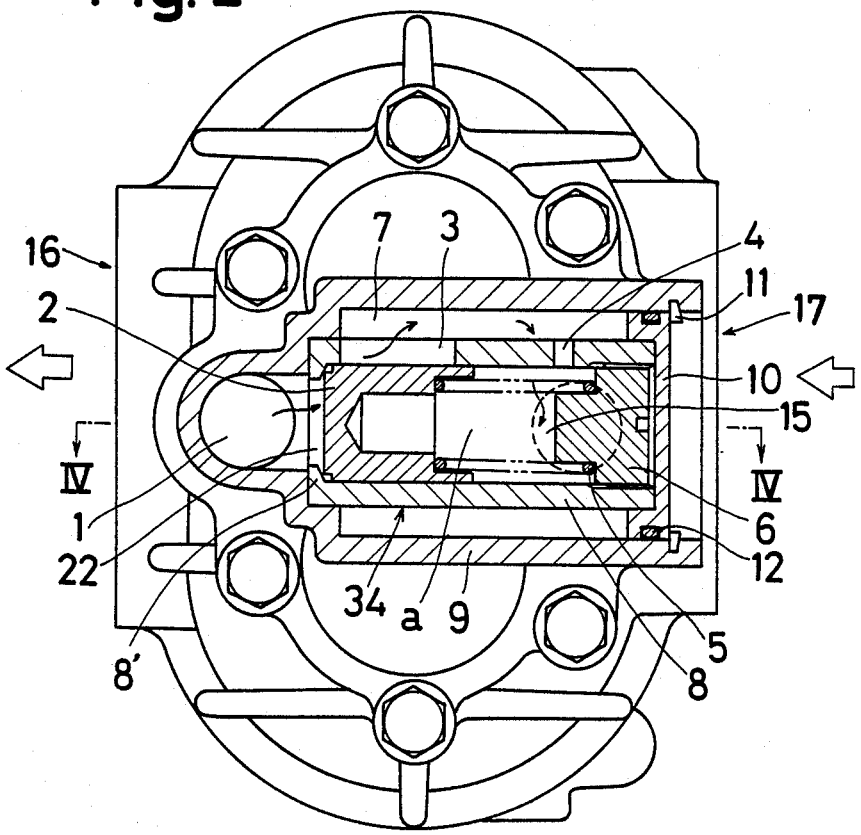
FIG. 2 is a sectional view of a relief valve.

Referring to FIG. 2 and FIG. 5, a relief valve 34 forming relief valve means is disposed in the chamber 7 between the passages 1 and 15 for controlling communication between the inlet port 17 and the outlet port 16. A valve member 2 is slidably disposed in the relief valve passage 22 of the insert member 8 in the housing 9. Interposed between the valve member 2 and an adjustment screw 6 is a spring 5 by which the valve member 2 is constantly biased toward a shoulder portion 8' of the insert member 8. When the valve member 2 is pressed against the shoulder portion 8', the communication between the relief valve passage 22 and the opening 3 thereof is interrupted by the valve member 2. The biasing force of the spring 5 can be adjusted by the screw 6. The inlet port pressure of the supercharger 23 is supplied to the chamber a of the relief valve 34 by means of the passage 15 communicating with the inlet port 17 and by means of a connecting opening 4. A cover member 10 is inserted between the housing 9 and the insert member 8 via an O-ring 12 so as to hermetically seal the chamber 7 formed between the housing 9 and the insert member 8. The cover member 10 is prevented from separating from the housing 9 by a snap ring 11.

In case a rotary type supercharger is utilized, the passage means is located so that the passage means does not damage the sealing of a chamber (shown by references b and c in FIG. 2) defined by the rotor and housing of the supercharger. Preferably, the passage means may be positioned between the two rotors.

In operation, when the supercharging pressure in the outlet port 16 is maintained below a predetermined value, the valve member 2 is maintained in the closed position by the biasing force of the spring 5 which is greater than the supercharging pressure applied to the valve member 2 through the passage 1. When the supercharging pressure in the outlet port 16 rises beyond the predetermined value, the valve member 2 will move against the force of the spring and will be maintained in the open position by the supercharging pressure applied to the valve member 2. When the valve member 2 is maintained in the open position, the supercharging pressure will be discharged to the passage 15 through the relief valve passage 22, the opening 3 and the chamber 7, thus maintaining the pressure in the outlet port 16 at a constant valve.

Figure 1:
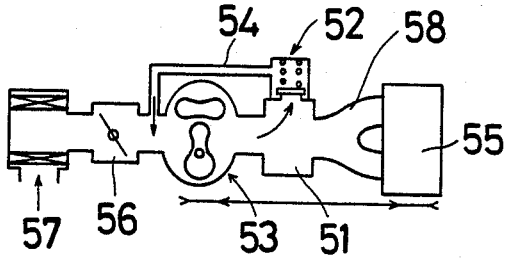
Fig. 1 Prior Art
FIG. 1 is a schematic view of an internal combustion engine with a conventional mechanical supercharger.

As indicated heretofore, since the relief valve 34 is accommodated within the supercharger and since the bypass passage is disposed in the housing of the supercharger, the bypass passage will be compact in size, and noises radiated from the passage can be reduced in comparison with the conventional conduit passage 54 shown in FIG. 1 which is separately positioned from the supercharger. Furthermore, because no conduit passage is connected with the housing of the supercharger, there are no joints from which gasoline vapors can leak from the conduit passage.

It will be apparent to those skilled in the art that the supercharger of the present invention may be constructed in a variety of ways without, however, departing from the scope and spirit of the appended claims.

What is claimed as new and desired to be secured by letters patent of the United States is:

1. A mechanical supercharger for compressing a precombustion intake mixture for an internal combustion engine, comprising:

a housing having an inlet port and an outlet port;

compression means in said housing for compressing the precombustion intake mixture provided through said inlet port and discharging the compressed precombustion mixture to said outlet port, said compression means comprising two rotors mounted on parallel shafts and means at one end of said shafts for rotatably driving said shafts;

passage means separate from said compression means and comprising a bypass passage disposed in said housing adjacent another end of said shafts and connecting said inlet port and said outlet port with each other;

relief valve means disposed in said passage means and comprising means for selectively releasing outlet port pressure to said inlet port vial said passage means, wherein said relief valve means comprises an insert member positioned in said passage means, said insert member having a relief valve passage communicating said inlet port with said outlet port, a relief valve slidably disposed in said insert member and positionable for closing said relief valve passage, and spring means for biasing said relief valve to close said relief valve passage, and a pressure equalizing opening independent of said relief valve passage and extending between an interior of said insert member and a portion of said passage means outside of said insert member.

2. The mechanical supercharger as defined in claim 1 wherein said housing includes an end cover and said passage means is positioned in said end cover.

3. A mechanical supercharger for compressing a precombustion intake mixture for an internal combustion engine, comprising:

a housing having an inlet port and an outlet port;

compression means in said housing, said compression means comprising two parallel shafts, each of said shafts supporting a rotor;

bearing means mounted in opposite ends of said housing for rotatably supporting said shafts;

rotational drive means attached to one end of each of said shafts for driving said shafts in synchronization, whereby said rotors rotate to compress gas from said inlet port and discharge the compressed gas to said outlet port;

an end cover on an end of said housing opposite said drive means;

passage means in said end cover for communicating said inlet port with said outlet port independently of said compression means;

relief valve means disposed in said passage means and comprising means for selectively releasing outlet port pressure to said inlet port via said relief valve, whereby said passage means and said rotational drive means are positioned at opposite ends of said housing, wherein said relief valve means comprises and insert member positioned in said passage means, said insert member having a relief valve passage communicating said inlet port with said outlet port, a relief valve slidably disposed in said insert member and positionable for closing said relief valve passage, and spring means for biasing said relief valve to close said relief valve passage; and a pressure equalizing opening independent of said relief valve passage and extending between an interior of said insert member and a portion of said passage means outside of said insert member.

4. The mechanical supercharger as defined in claim 3 wherein said rotational drive means comprises a driven pulley at said one end of one of said shafts and gear means at said one end of both of said shafts for rotationally uniting said shafts.

* * * * *